US007593653B2

(12) United States Patent
Richey et al.

(10) Patent No.: US 7,593,653 B2
(45) Date of Patent: Sep. 22, 2009

(54) OPTICAL SENSOR SYSTEM WITH A DYNAMIC THRESHOLD FOR MONITORING TONER TRANSFER IN AN IMAGE FORMING DEVICE

(75) Inventors: John Parker Richey, Lexington, KY (US); David Feinauer, Lexington, KY (US); Mark Alan Stuart, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 16 days.

(21) Appl. No.: 11/843,328

(22) Filed: Aug. 22, 2007

(65) Prior Publication Data

US 2009/0052911 A1 Feb. 26, 2009

(51) Int. Cl.
*G03G 15/08* (2006.01)

(52) U.S. Cl. ..... 399/27; 399/258; 399/260

(58) Field of Classification Search ..... 399/27, 399/51, 258, 262, 260
See application file for complete search history.

(56) References Cited

U.S. PATENT DOCUMENTS 4,742,372 A * 5/1988 Takahashi ..... 399/30
5,461,462 A * 10/1995 Nakane et al. ..... 399/15
2005/0238369 A1* 10/2005 Nakano et al. ..... 399/27

* cited by examiner

*Primary Examiner*—Thomas M Sember

(57) ABSTRACT

A method and device for monitoring toner transfer within an image forming device is described herein. A reflectivity sensor senses movement of a toner transfer gear operatively connected to a toner transfer system. A threshold unit generates a dynamic threshold based on the output of the reflectivity sensor. In one embodiment, the threshold unit generates the dynamic threshold based on a time delayed average of the sensor output. An instantaneous sensor output is compared to the dynamic threshold. Based on the comparison, the device determines the how much the toner transfer gear has rotated, and therefore, how much toner has been transferred from the toner cartridge.

20 Claims, 9 Drawing Sheets

OPTICAL SENSOR SYSTEM WITH A DYNAMIC THRESHOLD FOR MONITORING TONER TRANSFER IN AN IMAGE FORMING DEVICE

BACKGROUND

The present application is directed to methods and devices for monitoring toner transfer in an image forming device, and more particularly to optical reflectivity methods and devices for monitoring the toner transfer.

Image forming devices use toner to produce images on a media sheet. The toner may be housed within a toner cartridge that is refillable or removable from the image forming device. The toner cartridges are positioned within the image forming device at locations that provide convenient access to a user. Removal and installation of the toner cartridges may occur during initial start-up of the device, when the toner has been depleted from the cartridge, and miscellaneous other occurrences.

Toner cartridges may be replaceable or refillable to allow a user to input new toner into the image forming device after a first amount of toner originally within the device has been depleted. The image forming device should be designed to accurately monitor the amount of toner remaining in a toner cartridge to reduce operating costs, reduce toner waste, and to provide an accurate indicator of toner depletion. Further, the image forming device should be designed such that monitoring toner transfer does not greatly increase the manufacturing costs or size of the image forming device.

SUMMARY

The present application is directed to a device that monitors toner transfer within an image forming device. A reflectivity sensor senses movement of a toner transfer gear operatively connected to a toner transfer system. A threshold unit generates a dynamic threshold based on the output of the reflectivity sensor. In one embodiment, the threshold unit generates the dynamic threshold based on a time delayed average of the sensor output. An instantaneous sensor output is compared to the dynamic threshold. Based on the comparison, the device determines how much the toner transfer gear has rotated, and therefore, how much toner has been transferred from the toner cartridge. Based on this information, the device may determine how much toner remains in the toner cartridge.

DETAILED DESCRIPTION

Embodiments of the present application use a reflectivity sensor in conjunction with a dynamically generated threshold to determine how much toner has been transferred from a toner cartridge. In one embodiment, the dynamic threshold is generated based on a time delayed average of the reflectivity sensor output. By using a dynamic threshold, various embodiments minimize the impact of sensor tolerances on the manufacturing cost of the image forming device. Further, the dynamic threshold accommodates sensor degradation over the lifetime of the sensor, and therefore, reduces the affects of sensor degradation on the device performance.

Figure 1:
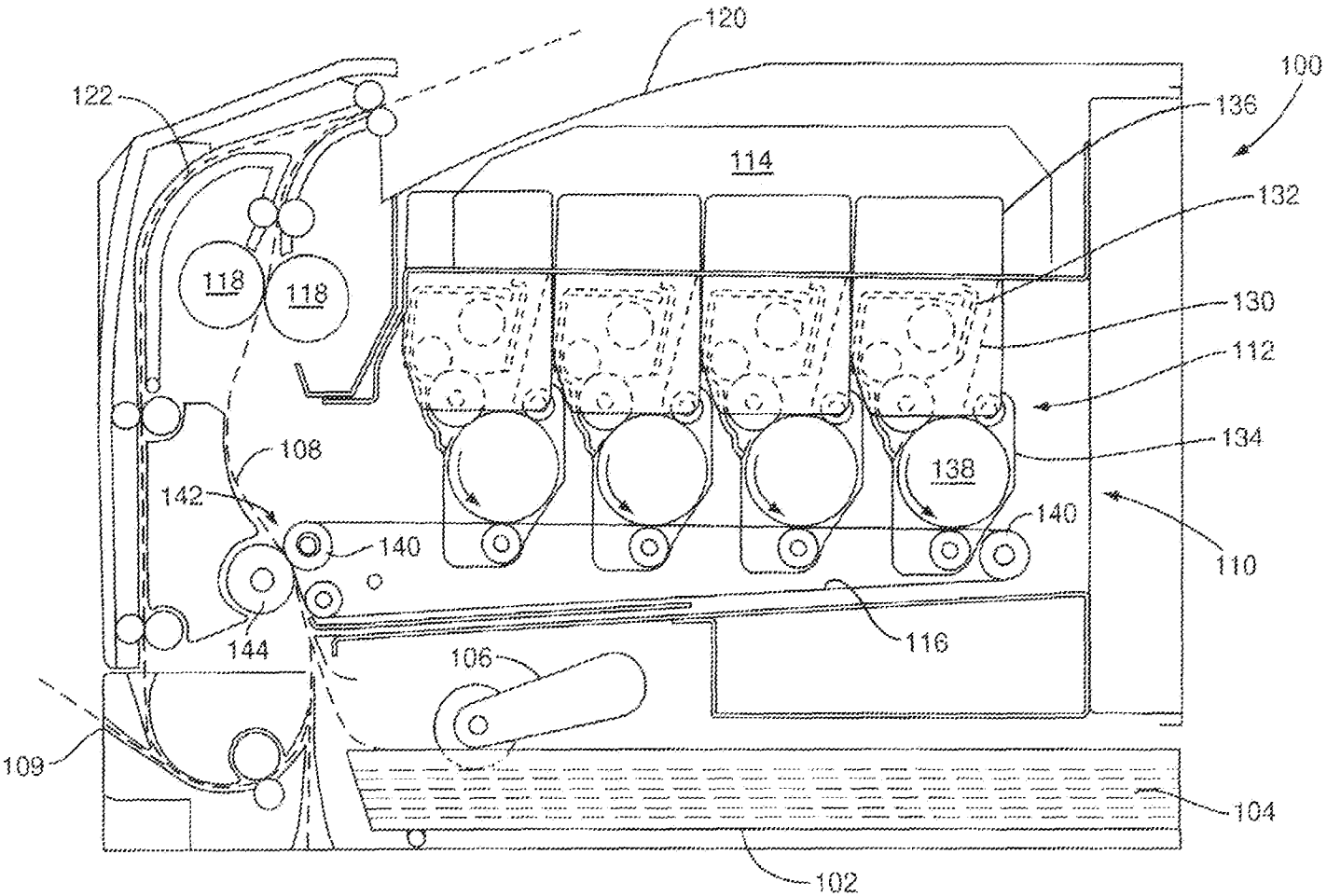
FIG. 1 shows a schematic side view of an image forming device according to one embodiment.

To facilitate the description of various embodiments, the following first provides a general description of one exemplary image forming device. It will be appreciated, however, that the various embodiments are not limited to the described or illustrated image forming device. FIG. 1 shows one embodiment of an image forming device 100. Device 100 includes an input tray 102 sized to contain a stack of media sheets 104. A pick mechanism 106 is positioned at the input tray 102 for moving a top-most sheet from the stack 104 and into a media path 108. Alternatively, the media sheet may move into the media path 108 via a manual feed 109. The media sheets move from the input tray 102 along the media path 108 to a second transfer area 142. The media sheet receives one or more toner images at the second transfer area 142. The media sheet with the toner images next moves through a fuser 118 to adhere the toner images to the media sheet. The media sheet is then either discharged into an output tray 120 or moved into a duplex path 122 for forming a toner image on a second side of the media sheet. Examples of the device 100 include Model Nos. C750 and C752, each available from Lexmark International, Inc. of Lexington, Ky., USA.

An image formation area 110 forms the toner images and moves them to the second transfer area 142. The area 110 includes an imaging unit 112, a laser printhead 114, and a transfer member 116. Imaging unit 112 includes one or more imaging stations 130 that each comprise a developer unit 132, a photoconductor unit 134, and a toner cartridge 136. In one embodiment, the toner cartridges 136 are independent of the imaging stations 130 and may be removed and replaced from the device 100 as necessary. In another embodiment, the toner cartridges 136 are integral with the imaging stations 130. In one embodiment, each imaging station 130 is mounted such that photoconductive (PC) members 138 in the photoconductor units 134 are substantially parallel. For clarity, the units 132, 134, and cartridge 136 are labeled on only one of the imaging stations 130 in FIG. 1. In one embodiment, device 100 is a monochromatic image forming device comprising a single imaging station 130 for forming toner images in a single color. In another embodiment, the imaging unit 112 includes multiple separate imaging stations 130, each being substantially the same except for the color of the toner. In one embodiment, the imaging unit 112 includes four imaging stations 130 each containing one of black, magenta, cyan, and yellow toner.

Laser printhead 114 includes a laser that discharges a surface of PC members 138 within each of the imaging stations 130. Toner from a toner cartridge 136 in the imaging station 130 attracts to the surface area of the PC members 138 affected by the laser printhead 114.

The transfer member 116 extends continuously around a series of rollers 140. Transfer member 116 receives the toner images from each of the PC members 138. In one embodiment, the toner images from each of the PC members 138 are placed onto transfer member 116 in an overlapping arrangement. In one embodiment, a multi-color toner image is formed during a single pass of the transfer member 116. By way of example, the yellow toner may be placed first on the transfer member 116, followed by cyan, magenta, and black. After receiving the toner images, transfer member 116 moves the images to the second transfer area 142 where the toner images are transferred to the media sheet. The second transfer area 142 includes a nip formed by a second transfer roller 144 and one of the rollers 140. A media sheet moves along the media path 108 through the nip to receive the toner images from the transfer member 116. The media sheet with the toner images next moves through the fuser 118 and discharges as discussed above.

Figure 2:
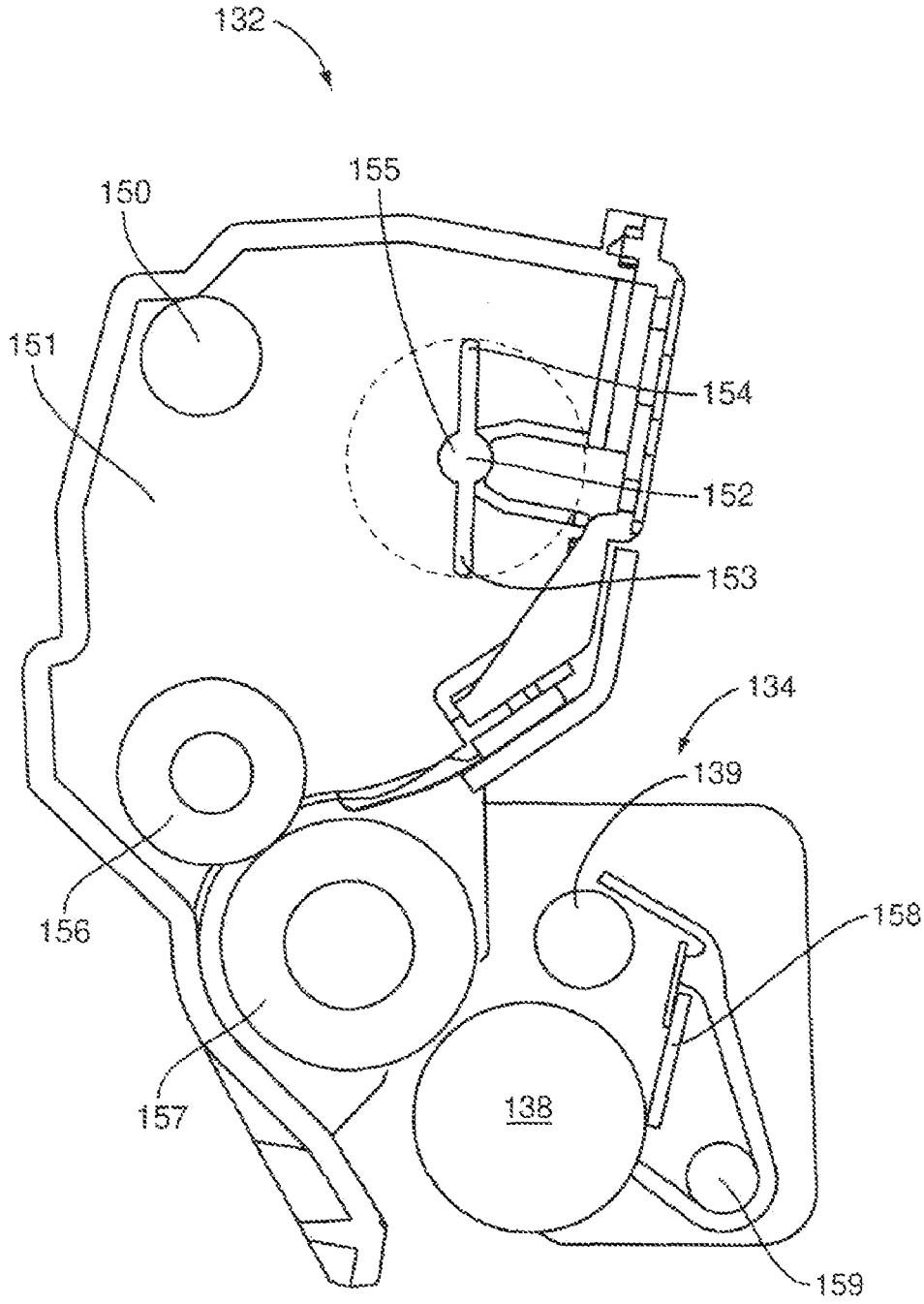
FIG. 2 shows a schematic side view of a developer unit and a photoconductor unit according to one embodiment.

FIG. 2 shows a sectional view of a developer unit 132 and a photoconductor unit 134. The developer unit 132 includes an inlet 150 that leads into a toner reservoir 151. A paddle 152 is positioned within the reservoir 151 to agitate and move the toner. Paddle 152 is rotatably positioned within the reservoir 151 and includes a first arm 153 and a second arm 154 that each extend outward on opposite sides of a shaft 155. A toner adder roll 156 is positioned to direct the toner towards the developer roll 157. The photoconductor unit 134 includes a charge roll 139 and a PC member 138 positioned to receive the toner from the developer roll 157. A blade 158 may be positioned against the PC member 138 to remove residual toner that is not transferred to the transfer member 116. The residual toner falls into a housing and is moved by an auger 159 laterally through and out of the photoconductor unit 134. In one embodiment, the developer unit 132 and the photoconductor unit 134 are separate members that are connected together as a single unit. One or more springs (not illustrated) may be positioned to maintain the developer roll 157 of the developer unit 132 in contact with the PC member 138 in the photoconductor unit 134.

Figure 3A:
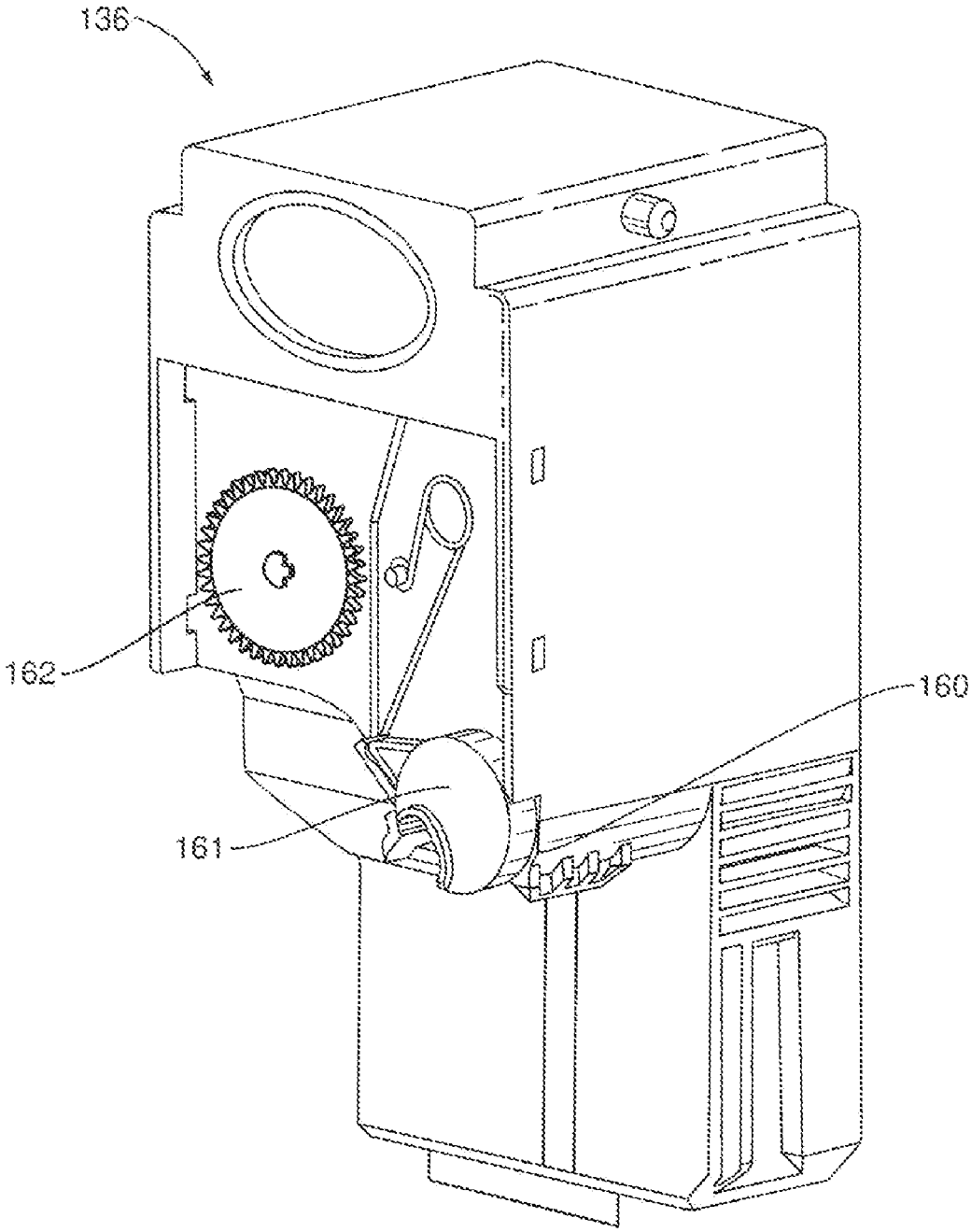
FIGS. 3A and 3C show respective front and back perspective views of a toner cartridge according to one embodiment.
Figure 3B:
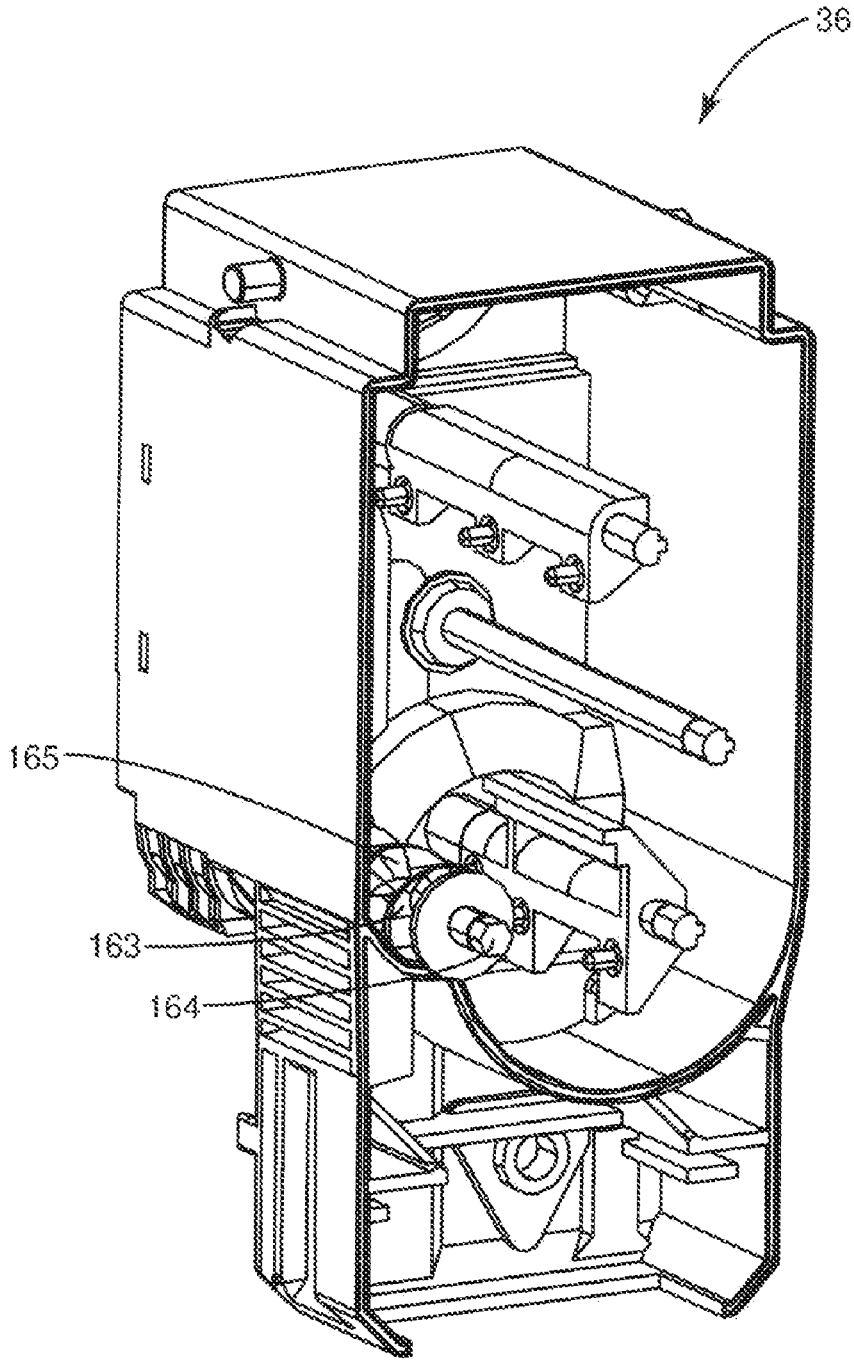
FIG. 3B shows a perspective view of an interior of a toner cartridge including a plurality of shafts according to one embodiment.
Figure 3C:
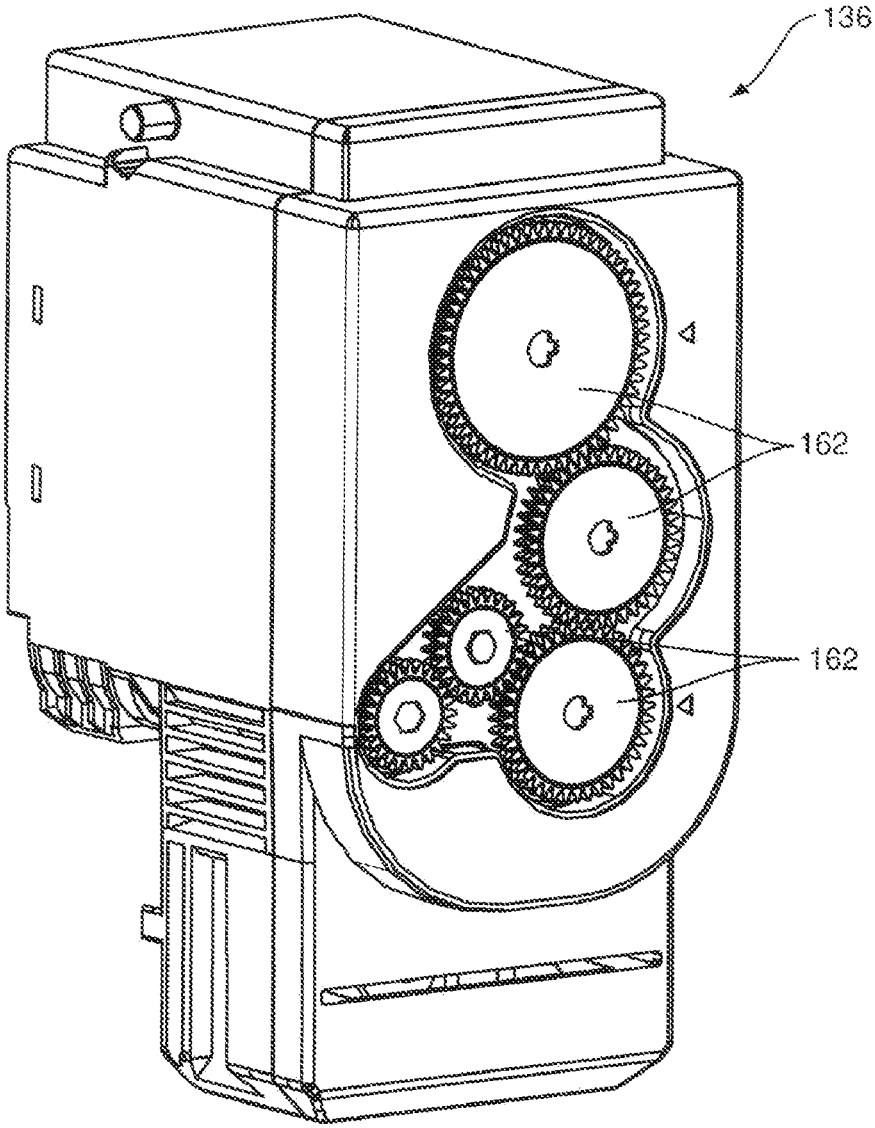

In one embodiment, toner is introduced through the inlet 150 of the developer unit 132 from a toner cartridge 136. FIGS. 3A-3C show one exemplary toner cartridge 136. Toner cartridge 136 includes an enclosed interior sized to hold a quantity of toner. The toner cartridge 136 includes an outlet 160 with a movable shutter 161. The shutter 161 is movable between a closed orientation to prevent toner from moving from the interior and an open orientation to allow the toner to move from the interior and into the developer unit 132. One or more toner transfer gears 162 are positioned on the exterior of the toner cartridge 136 to form a gear train. The gears 162 operatively connect to an auger 163 within the interior. Auger 163 includes a shaft 164 with an outwardly extending helical blade 165. Rotation of the shaft 164 causes toner to be moved by the blade 165 and directed towards the outlet 160. One embodiment of a toner cartridge is disclosed in U.S. patent application Ser. No. 11/556,863 entitled "Shutter for a Toner Cartridge for Use with an Image Forming Device" that was filed on Nov. 6, 2006, which is herein incorporated by reference.

Figure 4:
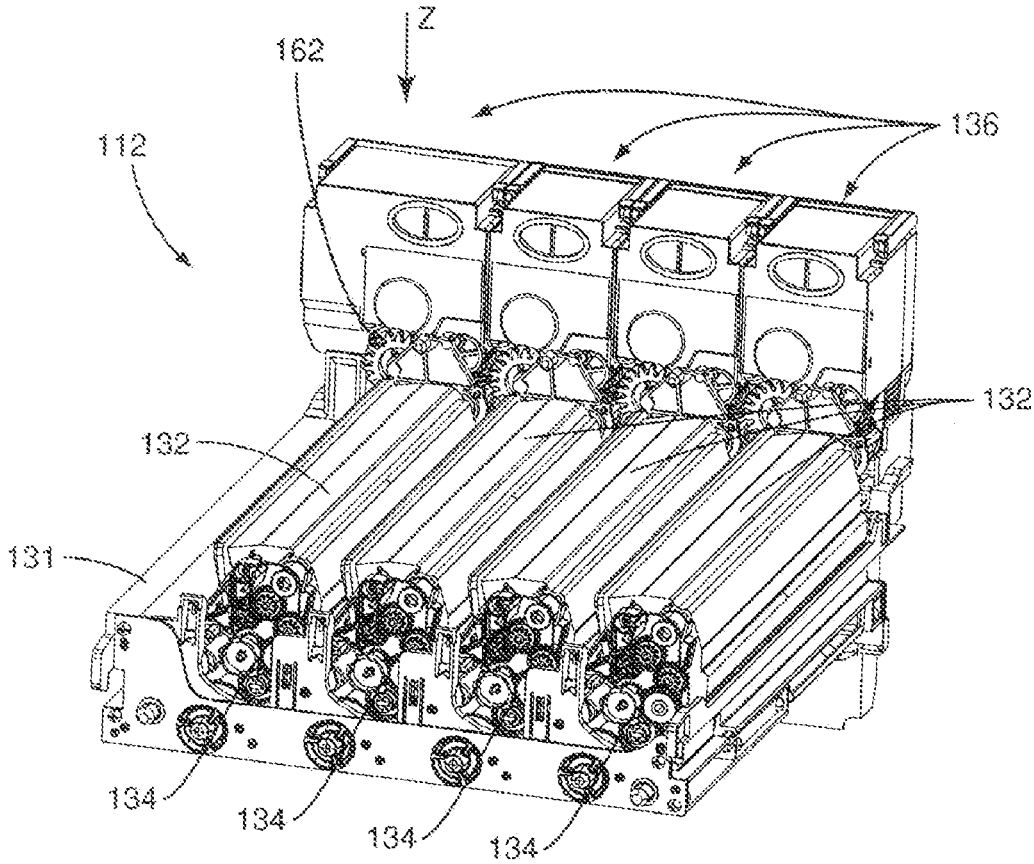
FIG. 4 shows a rear perspective view of an imaging unit comprising four imaging stations according to one embodiment.

An imaging unit 112 that includes one or more developer units 132, photoconductor units 134, and toner cartridges 136 may be positioned in a frame 131 within the body of the image forming device 100, as illustrated in FIG. 4. When the toner cartridges 136 are attached to the frame 131, the shutter 161 on the cartridges 136 moves from the closed orientation to the open orientation. When the transfer gear(s) 162 are activated, toner moves from the cartridges 136 and through the inlets 150 and into the reservoirs 151 of the developer units 132. The toner cartridges 136 may be removably attached to the frame 131 such that they can be replaced when the toner is depleted. In one embodiment, toner cartridges 136 are inserted in a vertical direction Z, as illustrated in FIG. 4, and mount to the top of the frame 131. The image forming device 100 may include a door along a top side to provide access for removal and insertion of the toner cartridges 136.

The toner cartridge 136 periodically transfers toner to the developer unit 132 during the printing process. When the developer unit 132 needs more toner, the gears 162 of the toner transfer system engage with a drive mechanism in the body of the image forming device 100, resulting in the rotation of the auger 163, which transfers the toner out of the toner cartridge 136 and into the developer unit 132.

To make sure that the developer unit 132 has enough toner to prevent excessive wear on the PC member 138 and developer roll 157, a minimum amount of toner is maintained in the developer unit 132. Thus, the image forming device 100 should include means for reliably monitoring the amount of toner left in the toner cartridge 136, and therefore, for reliably determining when the toner cartridge 136 needs to be refilled or replaced.

Figure 5A:
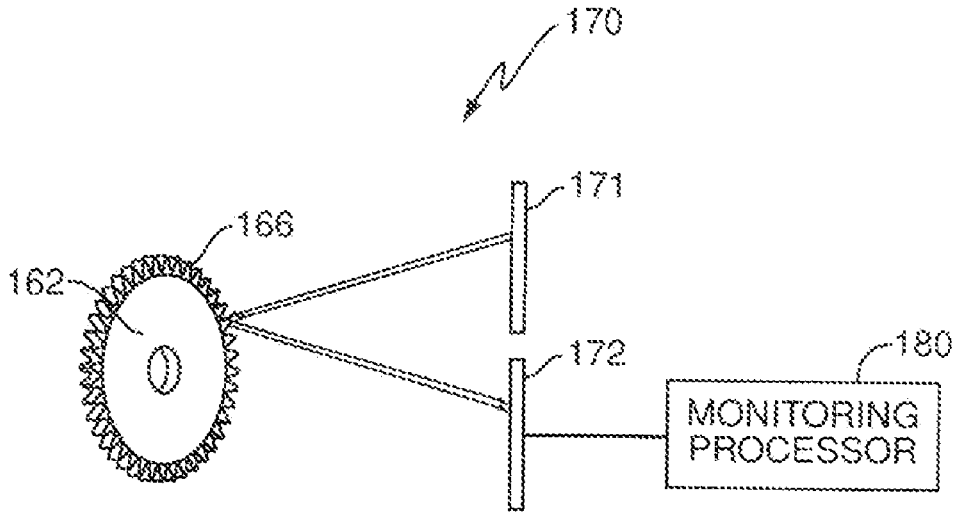
FIG. 5A shows a block diagram of a reflectivity sensor according to one embodiment.
Figure 5B:
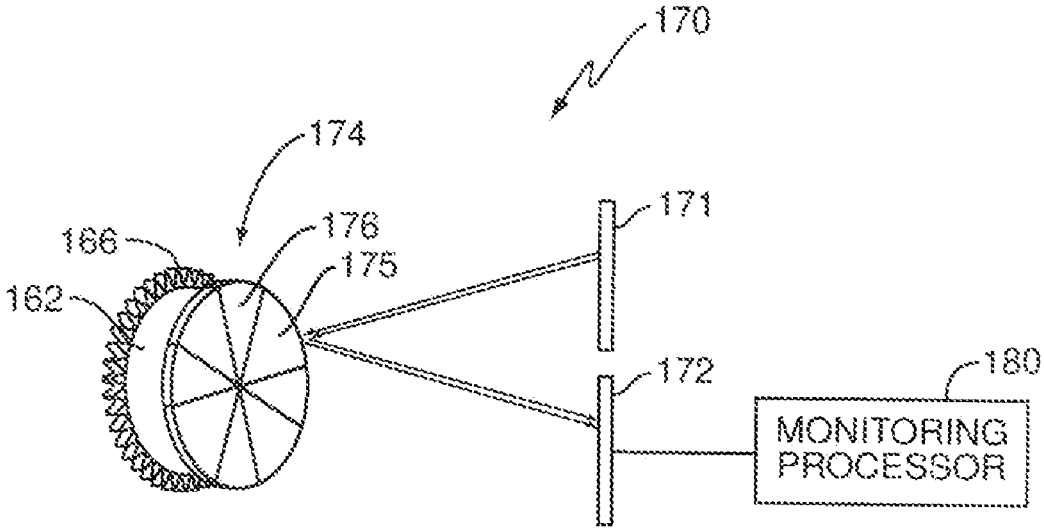
FIG. 5B shows a block diagram of a reflectivity sensor according to one embodiment.

In one embodiment, the image forming device 100 uses an optical reflectivity sensor 170 coupled to a monitoring processor 180 to detect rotation of one or more of the gears 162 in the gear train. As shown in FIGS. 5A and 5B, one embodiment of a reflectivity sensor 170 comprises a light emitting element 171, e.g., infrared light emitting diode (LED), and a light detection element 172, e.g., a phototransistor or a photodiode. Generally, light emitted by the light emitting element 171 is periodically reflected when the gear 162 rotates. Light detection element 172 responds proportionally to the amount of reflected light in its field of view.

In one embodiment shown in FIG. 5A, the reflectivity sensor 170 detects the rotations of the gear 162 by detecting light reflected directly by the teeth 166 of the toner transfer gear 162. In one embodiment shown in FIG. 5B, the reflectivity sensor 170 includes a reflective element 174 rotationally connected to the gear 162, where the reflective element 174 has a contrasting pattern of reflective areas 175 and absorptive areas 176. The reflective element 174 may be spaced from the gear 162 or may abut gear 162. In either case, the reflective element 174 rotates with the gear 162. In this embodiment, the reflective areas 175 reflect light emitted by the light emitting element 171, while the absorptive areas 176 at least partially absorb the emitted light. In either case, the amount of emitted light that is reflected and detected by light detecting element 172 changes as gear 162 rotates, which provides a sensor output indicative of gear movement.

Figure 6:
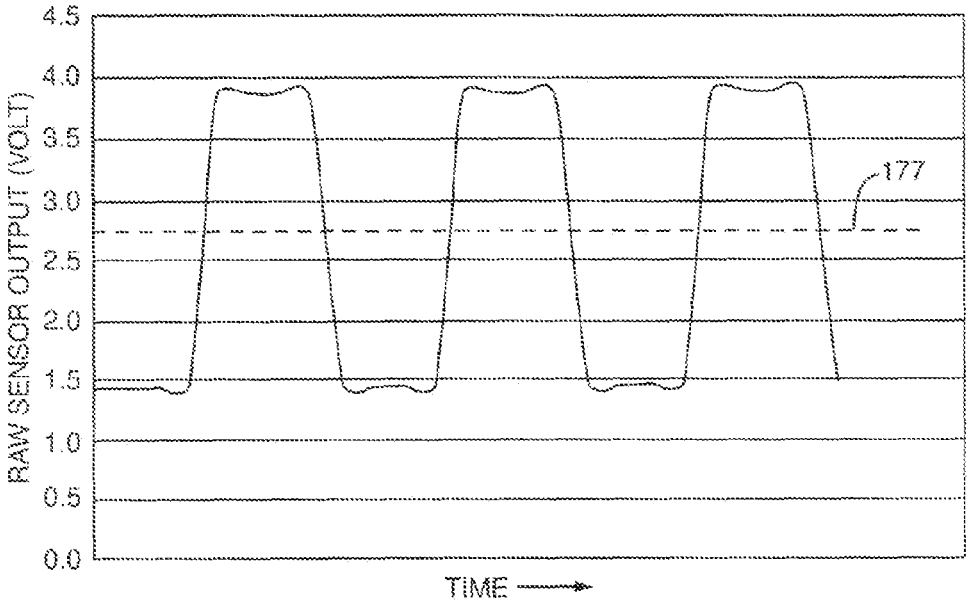
FIG. 6 shows one example of a reflectivity sensor output.

Monitoring processor 180 evaluates the output of the reflectivity sensor 170 to determine the amount of rotation of the gear 162, and therefore, the amount of toner transfer. FIG. 6 shows one exemplary output for the reflectivity sensor 170. Processor 180 uses a threshold 177 to detect the peaks and valleys of the sensor output. With knowledge of the contrasting pattern on the reflective element 174 and/or the configuration of the gear 162, processor 180 may determine how much the gear 162 has rotated based on the detected peaks and valleys. Based on the amount of gear rotation, processor 180 determines how much auger 163 has rotated. From that determination, the processor 180 may determine and monitor how much toner remains in the toner cartridge 136.

The above-described threshold process works when the selected threshold 177 falls between the maximum and minimum sensor output. However, the manufacturing process may produce elements 171, 172 having large performance variations, which makes pre-selecting a fixed threshold for all sensors difficult. For example, off-the-shelf light emitting elements 171 may have a 7:1 light output variation, and off-the-shelf light detection elements 172 may have a 3:1 light sensitivity variation from part to part, even within the same manufacturing batch. Further, many reflectivity sensors 170 are tuned for short detection distances, e.g., 1 mm. Thus, use of these sensors 170 for detection distances beyond the stated range may result in even larger part to part variations. It will be appreciated that other issues may cause additional performance variations, e.g., the age of the sensor components, variations in operating temperature, mechanical placement tolerances, and contamination along the optical path, including contamination of the reflective element 174 and/or gear 162.

Figure 7:
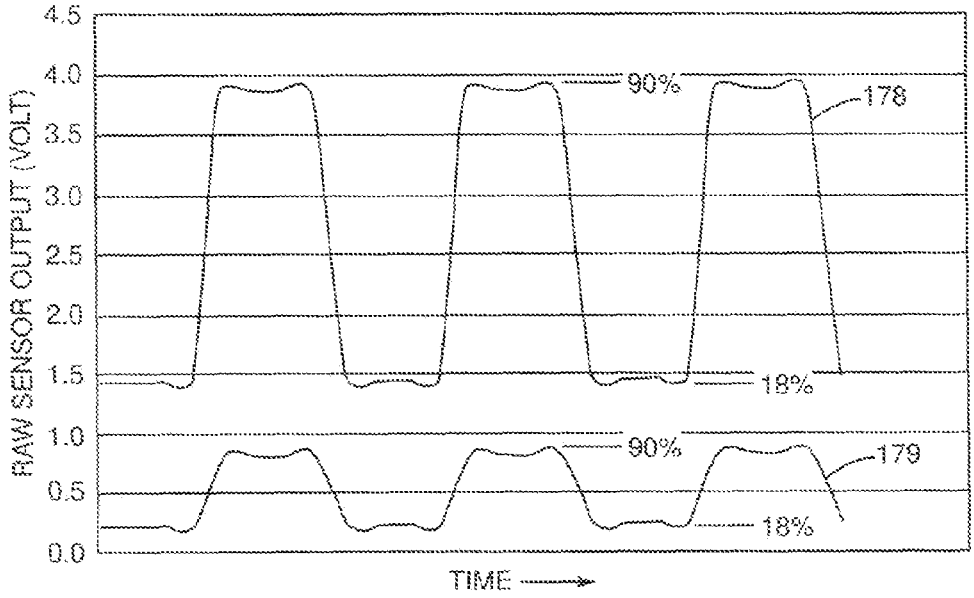
FIG. 7 shows potential differences between outputs for different reflectivity sensors.

FIG. 7 illustrates the performance variation problem. The output of the sensor 170 changes as the reflectivity of the material in the sensor's field of view changes. In FIG. 7, sensor output 178 represents the sensor output for a sensor 170 having a bright light emitting element 171 when the reflective element 174 or gear 162 has areas of 90% reflectivity and areas of 18% reflectivity, and sensor output 179 represents the sensor output for a sensor 170 having a dim light emitting element 171 when the reflective element 174 or gear 162 has areas of 90% reflectivity and 18% reflectivity. The two represented sensors 170 have identical specifications and part numbers. However, the sensor outputs 178, 179 in FIG. 7 show that one threshold value will not suffice for both sensors 170.

The above-described sensor variations make it difficult if not impossible to select one threshold for all sensors 170. Past methods for addressing this problem include sensor characterization during the manufacturing process, sensor calibration during the manufacturing process, hand tuning the sensor and/or threshold to achieve the desired response, etc. All of these techniques are labor intensive. Further, these techniques may cause an undesirably large number of sensors 170 to be rejected. In either case, past solutions generally increase product cost.

Figure 8A:
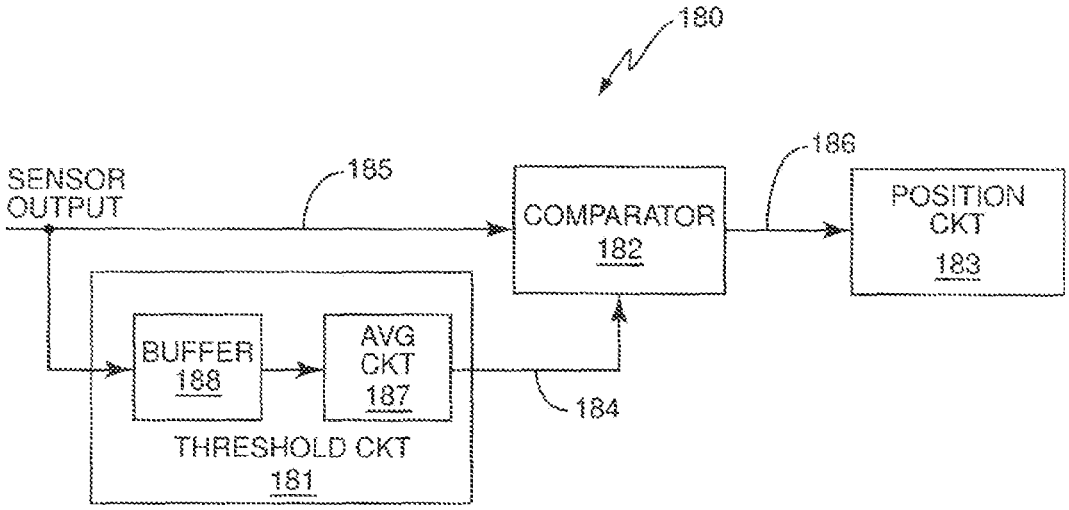
FIG. 8A shows a block diagram of a monitoring processor according to one embodiment.

Embodiments used herein may provide a monitoring processor 180 that addresses this problem by using a dynamically adjusting threshold. FIG. 8A shows one embodiment of a monitoring processor 180 comprising a threshold circuit 181, a comparator 182, and a position circuit 183. Threshold circuit 181 generates a dynamic threshold 184 for the reflectivity sensor 170 based on the output of the sensor 170. In one embodiment, threshold circuit 181 comprises an averaging circuit 187 and an optional buffer 188. Averaging circuit 187 generates the dynamic threshold 184 by generating a time delayed average of the sensor output. Buffer 188 isolates the dynamic threshold 184 from the sensor to prevent feedback. In one embodiment, averaging circuit 187 comprises a Resistor-Capacitor (RC) filter that filters the sensor output over a predetermined period of time to generate the time delayed average. Comparator 182 generates a binary output 186 based on a comparison between the current instantaneous sensor output 185 and the dynamic threshold 184. Position circuit 183 determines the amount of gear movement, and therefore the amount of toner transfer, based on multiple binary outputs 186. By averaging the sensor output over time, the threshold circuit 181 generates a dynamic threshold that accommodates the sensor's particular maximum and minimum sensitivity values, even if those values change over time.

Figure 8B:
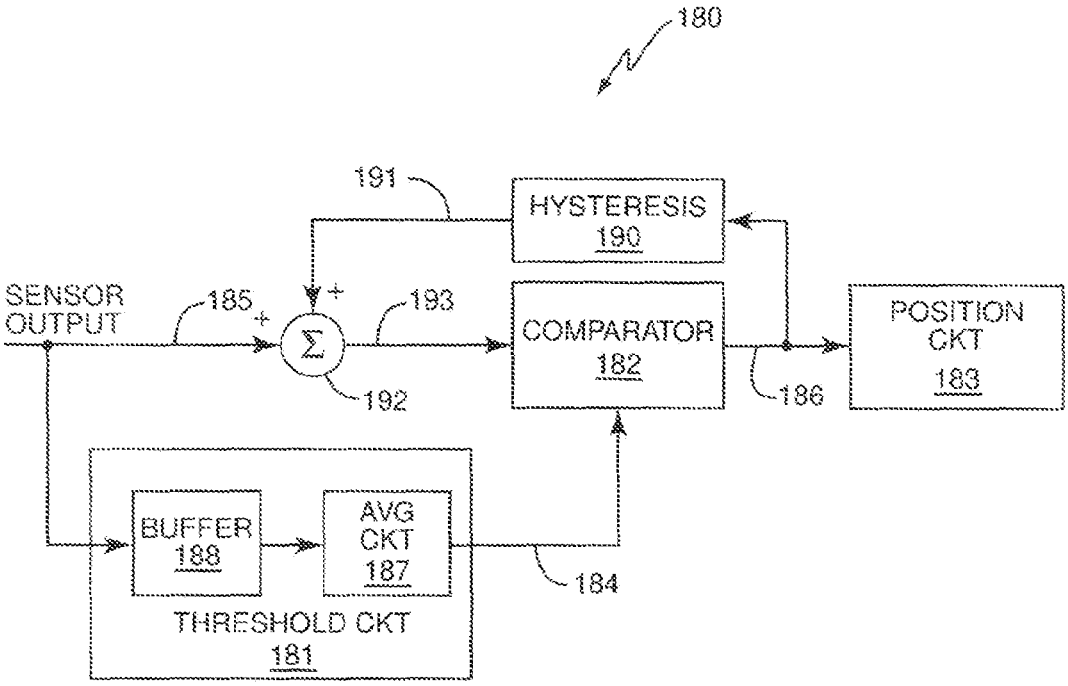
FIG. 8B shows a block diagram of a monitoring processor according to one embodiment.

FIG. 8B shows one embodiment that adds a hysteresis feedback filter 190 to the embodiment of FIG. 8A. The hysteresis filter 190 may be implemented to reduce jitter in the binary output 186 that may be produced, for example, when the instantaneous sensor output 185 is noisy and/or when the instantaneous sensor output 185 and the dynamic threshold 184 have approximately the same value. To reduce the jitter, the hysteresis filter 190 filters the binary output 186 according to any known means. Combiner 192 combines the filter output 191 with the current instantaneous sensor output 185 to generate a modified instantaneous sensor output 193 having a reduced noise level.

While the above describes and illustrates the monitoring processor 180 as an independent processor, it will be appreciated that one or all of the monitoring processor 180 may be incorporated with a control processor (not shown) in the image forming device 110. Further, it will be appreciated that one monitoring processor 180 may process the output of one reflectivity sensor 170 or multiple reflectivity sensors 170 associated with the same or different toner cartridges 136.

The above-described embodiments monitor toner transfer from a toner cartridge 136 to a developer unit 132. However, it will be appreciated that the various embodiments described herein are not so limited and may be used to monitor toner transfer in other areas of the image forming device 100.

The various embodiments described herein may, of course, be carried out in other ways than those specifically set forth herein without departing from the essential characteristics. The present embodiments are to be considered in all respects as illustrative and not restrictive, and all changes coming within the meaning and equivalency range of the appended claims are intended to be embraced therein.

What is claimed is:

1. A method of monitoring toner transfer within an image forming device, the method comprising:

sensing movement of a toner transfer gear associated with directing toner from a toner cartridge, using a reflectivity sensor;

determining a dynamic threshold based on a sensor output from the reflectivity sensor;

determining an amount of rotation of the toner transfer gear based on a comparison between an instantaneous sensor output from the reflectivity sensor and the dynamic threshold; and determining an amount of toner transfer within the image forming device based on the amount of rotation of the toner transfer gear.

2. The method of claim 1 wherein generating the dynamic threshold comprises:

determining a time delayed average of the sensor output; and generating the dynamic threshold based on the time delayed average of the sensor output.

3. The method of claim 2 wherein determining the time delayed average of the sensor output comprises filtering the sensor output.

4. The method of claim 1 wherein the toner transfer gear operatively connects to an auger within the toner cartridge, the method further comprising determining the amount of rotation of the auger based on the amount of rotation of the toner transfer gear.

5. The method of claim 4 wherein determining the amount of the toner transfer comprises monitoring the toner transfer based on the amount of rotation of the auger.

6. The method of claim 1 further comprising applying a hysteresis feedback system between the comparison output and the sensor output to reduce noise associated with the comparison output.

7. The method of claim 1 wherein sensing movement of the toner transfer gear comprises sensing light reflected by the toner transfer gear using the reflectivity sensor.

8. The method of claim 1 wherein the reflectivity sensor includes a reflective element operatively connected to toner transfer gear and movable with the toner transfer gear, and wherein sensing movement of the toner transfer gear comprises sensing light reflected by the reflective element.

9. A device to monitor toner transfer in an image forming device, comprising:

a toner transfer gear associated with directing toner from a toner cartridge;

a reflectivity sensor to sense movement of the toner transfer gear; and a monitoring unit comprising:

a threshold unit to generate a dynamic threshold based on a sensor output from the reflectivity sensor;

a comparator to compare an instantaneous sensor output to the dynamic threshold; and a position unit configured to:

determine an amount of rotation of the toner transfer gear based on the comparator output; and determine an amount of toner transfer within the image forming device based on the amount of rotation of the toner transfer gear.

10. The device of claim 9 wherein the threshold unit comprises an averaging unit configured to determine a time delayed average of the sensor output, and wherein the threshold unit generates the dynamic threshold based on the time delayed average of the sensor output.

11. The device of claim 10 wherein the averaging unit comprises an RC filter.

12. The device of claim 9 wherein the toner transfer gear operatively connects to an auger within the toner cartridge, and wherein the position unit determines the amount of rotation of the auger based on the amount of rotation of the toner transfer gear.

13. The device of claim 12 wherein the position unit monitors the toner transfer based on the amount of rotation of the auger.

14. The device of claim 9 further comprising a feedback system disposed between the comparator output and the sensor output, said feedback system configured to reduce comparator output noise.

15. The device of claim 14 wherein the feedback system comprises a hysteresis feedback system.

16. The device of claim 9 wherein the reflectivity sensor comprises:

a light emitting element;

a reflective element operatively connected to the toner transfer gear and movable with the toner transfer gear; and a light detection element to detect light emitted by the light emitting element and reflected by the reflective element.

17. The device of claim 9 wherein the reflectivity sensor comprises:

a light emitting element; and a light detection element, wherein the light detection element detects light emitted by the light emitting element and reflected by the toner transfer gear.

18. An imaging system, comprising:

one or more imaging stations, each imaging station including a developer unit and a photoconductive unit;

one or more removable toner cartridges, each toner cartridge being selectively engaged with a developer unit for supplying toner thereto, each toner cartridge including a directing mechanism for directing toner from the toner cartridge to a developer unit when engaged therewith, each toner cartridge including an externally disposed drive component operably coupled to the directing mechanism for driving the directing mechanism; and a mechanism for determining an amount of toner transferred from the toner cartridge, comprising a sensor for sensing movement of the drive component and a monitor processing unit for receiving an output from the sensor and determining the toner amount transferred, the monitor processing unit dynamically determining a threshold value against which the sensor output is compared, the dynamically determined threshold value varying based upon changes in a range of the sensor output.

19. The imaging system of claim 18, wherein the monitor processing unit comprises a threshold circuit having an output corresponding to the threshold value, the threshold value being a time delayed average of the sensor output.

20. The imaging system of claim 18, wherein the drive component comprises a gear divided into portions with alternating amounts of optical reflectivity.

* * * * *